US011423870B2

(12) United States Patent
Kaletta et al.

(10) Patent No.: US 11,423,870 B2
(45) Date of Patent: Aug. 23, 2022

(54) METHODS AND SYSTEMS FOR GAPLESS AUDIO-PRESET SWITCHING IN AN ELECTRONIC MUSICAL-EFFECTS UNIT

(71) Applicants: Manuel Kaletta, Oldenburg (DE); Mario Reinsch, Bremen (DE); John E. O'Donnell, Fort Lauderdale, FL (US)

(72) Inventors: Manuel Kaletta, Oldenburg (DE); Mario Reinsch, Bremen (DE); John E. O'Donnell, Fort Lauderdale, FL (US)

(73) Assignee: INMUSIC BRANDS, INC., Cumberland, RI (US)

( * ) Notice: Subject to any disclaimer, the term of this patent is extended or adjusted under 35 U.S.C. 154(b) by 0 days.

(21) Appl. No.: 16/963,448

(22) PCT Filed: Jan. 19, 2018

(86) PCT No.: PCT/US2018/014580
§ 371 (c)(1),
(2) Date: Jul. 20, 2020

(87) PCT Pub. No.: WO2019/143363
PCT Pub. Date: Jul. 25, 2019

(65) Prior Publication Data

US 2021/0043176 A1 Feb. 11, 2021

(51) Int. Cl.
*G10H 1/00* (2006.01)
*G10H 1/34* (2006.01)
*G10H 3/18* (2006.01)

(52) U.S. Cl.
CPC ..... *G10H 1/0091* (2013.01); *G10H 1/348* (2013.01); *G10H 3/186* (2013.01); *G10H 2210/155* (2013.01); *G10H 2220/096* (2013.01)

(58) Field of Classification Search
CPC ..... G10H 1/0091; G10H 1/348; G10H 3/186; G10H 2220/096; G10H 2210/155
(Continued)

(56) References Cited

U.S. PATENT DOCUMENTS 3,969,588 A * 7/1976 Raydon ..... H04S 7/30 381/61
5,444,180 A * 8/1995 Shioda ..... G10H 1/0091 84/630

(Continued)

FOREIGN PATENT DOCUMENTS

WO 2019143363 A1 7/2019

OTHER PUBLICATIONS

Boss, "GT-10: Guitar Effects Processor Owner's Manual", 2008, https:/www.boss.info/global/support/by_product/gt-10/owners_manuals/, pp. 10-12,14,16,17,68,98, 136,138,142,144 (Year: 2008).*

(Continued)

*Primary Examiner* — Christina M Schreiber
(74) *Attorney, Agent, or Firm* — Burns & Levinson LLP

(57) ABSTRACT

A guitar multi-effects pedalboard is provided. The pedalboard has footswitches and a memory storing guitar-effect presets for processing an inputted guitar signal when the processing is triggered by pressing a footswitch. The pedalboard has one or more processors coupled to the memory and configured to process a first portion of an inputted guitar signal on a first audio-engine thread with a first guitar-effect preset when processing the first portion is triggered by pressing a footswitch. The one or more processors also process a second portion of the inputted guitar signal on a second audio-engine thread with a second guitar-effect preset while simultaneously processing the first portion of the inputted guitar signal on the first audio-engine thread with the first guitar-effect preset when processing the second (Continued)

portion is triggered by pressing a footswitch. The one or more processors simultaneously output the processed first portion and the processed second portion.

20 Claims, 6 Drawing Sheets

(58) Field of Classification Search
USPC ..... 381/61
See application file for complete search history.

(56) References Cited

U.S. PATENT DOCUMENTS 5,475,214 A * 12/1995 DeFranco ..... G01S 17/04 250/221
8,874,245 B2 * 10/2014 Reinsch ..... G10H 1/46 700/94
9,922,630 B2 * 3/2018 Ceccolini ..... G06F 9/451
2006/0011052 A1 * 1/2006 Purchon ..... G10H 1/0091 84/746
2008/0167740 A1 * 7/2008 Merrill ..... G10H 1/0091 700/94
2010/0037755 A1 * 2/2010 McMillen ..... G10H 1/342 84/645
2010/0269670 A1 * 10/2010 O'Connor ..... G10H 1/348 84/746
2012/0192703 A1 * 8/2012 Fuller ..... G10H 1/0091 84/746
2013/0087037 A1 * 4/2013 Dreher ..... G10H 1/46 84/645
2013/0154920 A1 * 6/2013 Radin ..... G10H 1/348 345/156
2013/0156199 A1 * 6/2013 O'Donnell ..... H03G 3/3089 381/103
2013/0327201 A1 * 12/2013 Urry ..... G10H 1/348 84/626
2015/0262566 A1 * 9/2015 Ceccolini ..... G10H 1/0091 84/746
2020/0365127 A1 * 11/2020 Souppa ..... G10H 1/342
2021/0043176 A1 * 2/2021 Kaletta ..... G10H 3/186

OTHER PUBLICATIONS

International Preliminary Report on Patentability, International Application No. PCT/US18/14580 (7 pages).
International Search Report for International Application No. PCT/US2018/014580, 2 pages (dated Apr. 13, 2018).
Written Opinion for International Application No. PCT/US2018/014580, 6 pages (dated Apr. 13, 2018).
Boss "GT-10 Guitar Effects Processor Owner's Manual", Article [online], Jan. 10, 2010 [retreived on Mar. 14, 2018], Retreived from Internet: <URL: https://staticsoland.com/assets/media/pdf/GT-10_0M.pdf> see excerpt from document, pp. 10-12, 14, 16, 17, 68, 98, 136, 138, 142, 144.
Boss "GT-10 Guitar Effects Processor Workshop", Article [online], Jun. 10, 2010 [retreived on Mar. 15, 2018], Retreived from Internet: <URL: http://cms.rolandus.com/assets/media/pdf/GT10WS01.pdf> pp. 3-5 & 9.

* cited by examiner

METHODS AND SYSTEMS FOR GAPLESS AUDIO-PRESET SWITCHING IN AN ELECTRONIC MUSICAL-EFFECTS UNIT

CROSS-REFERENCE TO RELATED APPLICATIONS

This application is a national stage entry of PCT Application No. PCT/US2018/014580, which was filed on Jan. 19, 2018. This application claims priority to PCT Application No. PCT/US2018/014580. The contents of PCT Application No. PCT/US2018/014580 is incorporated herein by reference in its entirety for all purposes.

TECHNICAL FIELD

The present disclosure relates generally to methods and systems for gapless audio-preset switching in an electronic musical-effects unit.

BACKGROUND

Electric guitarists and electric bass-guitar players can use one or more guitar effects while playing an electric guitar or electric bass guitar. Such effects receive a signal outputted by one or more variable-reluctance sensors on the guitar (e.g., guitar pickups) and modify it to alter its sonic characteristics. Examples of such effects include distortion, compressor, chorus, and delay. A discrete pedal may provide a single effect. Guitarists can use a plurality of discrete pedals connected in series and/or parallel with multiple electrical cables such that each pedal imparts a particular guitar effect onto the signal. For example, one discrete pedal may provide a distortion effect, another discrete pedal may provide a compression effect, etc. A discrete pedal may have a footswitch and may be activated or deactivated by pressing the footswitch. For example, guitarists may activate or deactivate a distortion pedal depending on the whether they desire their guitar tone to be distorted. Guitarists may use their feet to press the footswitch in order to simultaneously play with their hands. To facilitate pressing the footswitch with the guitarists' feet, the discrete pedals may be placed on the ground. A discrete pedal may be designed with a unique appearance so as to differ from other discrete pedals. This allows guitarists to quickly distinguish between different pedals while playing on the stage. This may be helpful, for example, when playing in environments with unusual or suboptimal lighting conditions (e.g., clubs, bars, concert halls, etc.).

Because a discrete pedal may provide a single effect, guitarists may desire having multiple discrete pedals. But using multiple discrete pedals has disadvantages. Traveling with or otherwise moving multiple discrete pedals may be cumbersome for guitarists. Moving multiple pedals may involve disconnecting each pedal, packing each pedal, packing each pedal's power supply, keeping track of which power supply is associated with which pedal, relocating the multiple pedals, and/or reconnecting the pedal signal chain. Another disadvantage of having multiple discrete pedals is the large number of steps that may be required to change a guitarist's tone. For example, guitarists may need to select and deselect many effects to get their desired tone for a forthcoming musical piece. These steps may need to be performed quickly (e.g., while an audience waits between songs). Some steps may require turning knobs on one or more pedals, which could be time consuming and require guitarists to kneel down while holding their guitar. Yet another disadvantage of having multiple discrete pedals is the time required for reconfiguring the signal chain. For example, it may take a long time to insert a pedal into a proper location in the signal chain because of the time required to determine how the existing configuration is connected and to physically make the proper connections.

The disclosed systems and methods are directed to overcoming one or more of the problems set forth above and/or other problems or shortcomings in the prior art.

BRIEF DESCRIPTION OF THE DRAWINGS

The accompanying drawings, which are incorporated into and constitute a part of this specification, illustrate the disclosed embodiments and, together with the description, serve to explain the principles of the various aspects of the disclosed embodiments. In the drawings.

Figure 1:
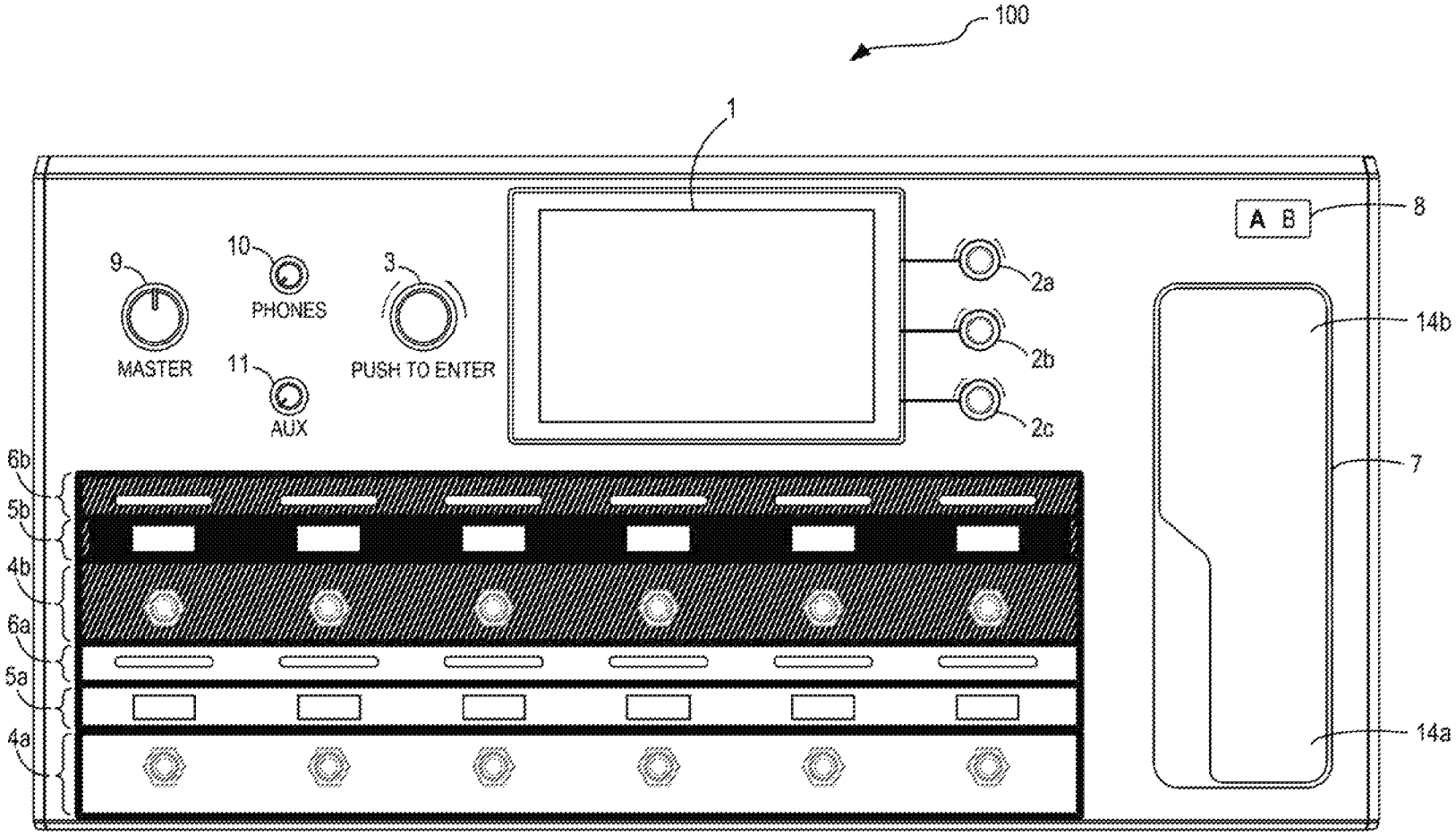
FIG. 1 illustrates a top view of an exemplary multi-effects unit.

It is to be understood that both the foregoing general descriptions and the following detailed descriptions are exemplary and explanatory only and are not restrictive of the claims.

DESCRIPTION OF EXEMPLARY EMBODIMENTS

Reference will now be made to certain embodiments consistent with the present disclosure, examples of which are illustrated in the accompanying drawings. Wherever possible, the same reference numbers will be used throughout the drawings to refer to same or like parts.

The present disclosure describes methods and systems for gapless audio-preset switching in an electronic musical-effects unit.

To avoid some of the above shortcomings of discrete pedals, guitarists may use an integrated multi-effects unit. A multi-effects unit provides a plurality of effects. A multi-effects unit may be thought of as a single unit that integrates multiple discrete pedals into one. A multi-effects unit may have one or more footswitches. A multi-effects unit may be easier to move than multiple discrete pedals because a multi-effects unit may provide a plurality of effects within a single housing. Multiple effects on a multi-effects unit can be activated and/or deactivated with, for example, a single press of a footswitch thereon. Parameters that would need to be modified with knobs on discrete pedals may be modified with, for example, a single press of a footswitch on a multi-effects unit.

Integrated multi-effects units may modify guitarists' signals using digital signal processing. Guitarists' desired effects, signal chain, and parameters are stored in computer-readable non-transitory memory. A particular combination of effects, the corresponding signal chain of the effects, and the parameters for the effects may be referred to as "a preset." As discussed above, a preset may be recalled with, for example, a single press of a footswitch; however, retrieving a preset from memory and providing the necessary data to a digital signal processor takes time. During this time, an audible gap may be introduced into the audio signal outputted by a multi-effects unit. This audible gap may be undesirable to a guitarist seeking to continuously play while changing the effects, signal chain, and/or parameters used by the multi-effects unit (e.g., by changing the preset).

A multi-effects unit may comprise a display to provide guitarists with information pertaining to effects, the signal chain, and/or parameters. Conventional displays, however, may not provide a guitarist with sufficient information about the effects, the signal chain, or parameters. These displays may not provide a guitarist with information about the effects, the signal chain, or parameters in a manner that is quickly and easily discernable (e.g., during a high-energy performance in a poorly lit bar). For example, conventional displays may not allow a guitarist to quickly and easily tell apart two effects and determine which footswitch controls a particular effect. These displays may not provide a guitarist with information needed to modify which effects are selected, the signal chain, or parameters quickly and easily. These deficiencies may be especially inconvenient when the display is a substantial distance from the guitarist's eyes (e.g., on the floor while a guitarist is standing).

FIG. 1 shows one illustrative embodiment of a multi-effects unit generally at 100. Multi-effects unit 100 includes a display 1. Display 1 may show information relevant to multi-effects unit's 100 current operating state. Display 1 is a full-color display. Display 1 is a touchscreen display, such as a multi-touch display. Display 1 and/or other hardware controls are used to control multi-effects unit 100.

Other hardware controls such as encoders, footswitches, pedals, knobs, or buttons may be used to make selections from display 1. Parameter knobs 2*a*, 2*b*, and 2*c* are rotated to adjust parameters or settings shown on display 1. As discussed below with respect to FIG. 4, one or more of parameter knobs 2*a*, 2*b*, or 2*c* are rotated to adjust one or more parameters 438*a*, 438*b*, and 438*c* displayed near one or more of the knobs. For example, knob 2*a* may adjust parameter 438*a*, knob 2*b* may adjust parameter 438*b*, and knob 2*c* may adjust parameter 438*c*.

Rotary encoder 3 is rotated to scroll through displayed menu options on display 1 and/or adjust selected parameter values. Rotary encoder 3 is pushed to confirm a selection.

Footswitches 4*a*, 4*b* may be pressed to activate or deactivate a discrete simulated effect pedal. Footswitches 4*a*, 4*b* may be pressed to load a preset, activate a tuner, change the view displayed on display 1 or other displays (discussed below), and/or change a tempo associated with a preset.

Expression pedal 7 may be used to adjust one or more parameters, as discussed below with respect to FIG. 4. Expression pedal 7 may have a bottom portion 14*a* and a top portion 14*b*. One or more expression-pedal light-emitting diodes 8 provide information relevant to the operation of expression pedal 7. While a single expression pedal 7 is shown, it is to be understood that multi-effects unit 100 may comprise no expression pedals, a single expression pedal, or multiple expression pedals.

Multi-effects unit 100 comprises one or more knobs. A master-volume knob 9 is rotated to adjust the volume of the sound signal outputted through one or more outputs of multi-effects unit 100, discussed below with respect to FIG. 2. For example, master-volume knob 9 is rotated to adjust the volume of the sound signal outputted through main outputs. A headphones-volume knob 10 is rotated to adjust the volume of the sound signal outputted through a headphones output. An auxiliary-volume knob 11 is rotated to adjust the volume of a sound signal received at an auxiliary input.

Multi-effects unit 100 may have displays and/or indicators instead or in addition to display 1. Footswitch displays 5*a* and 5*b* are shown positioned above footswitches 4*a* and 4*b*, respectively. Footswitch displays 5*a* show information relevant to the operation of footswitches 4*a* and footswitch displays 5*b* show information relevant to the operation of footswitches 4*b*. For example, one of footswitch displays 5*a* positioned near (e.g., above) one of footswitches 4*a* may display the name of a discrete effect pedal simulator associated with one of footswitches 4*a*. In some embodiments, pressing one of footswitches 4*a* may activate or deactivate the discrete effect pedal with the name displayed on one of footswitch displays 5*a* above the one of footswitches 4*a*. One of footswitch displays 5*a* for a specific one of footswitches 4*a* may have a color matching that of the pedal shown on display 1 that is activated and deactivated by the specific one of footswitches 4*a*. One or more of footswitch displays 5 may be an organic light-emitting diode display, a light-emitting diode display, or a liquid crystal display.

Footswitch indicators 6*a* and 6*b* provide information relevant to the operation of footswitches 4*a* and 4*b*, respectively, and/or, generally, multi-effects unit 100. For example, one of footswitch indicators 6*a* positioned near (e.g., above) one of footswitches 4*a* may be dimly lit or off to indicate that a discrete effect pedal simulator associated with the one of footswitches 4*a* is disabled. The one of footswitch indicators 6*a* may be brightly lit or lit with another brightness to indicate that a discrete effect pedal simulator associated with the one of footswitches 4*a* is enabled. One or more of footswitch indicators 6*a*, 6*b* are light-emitting diodes.

Figure 2:
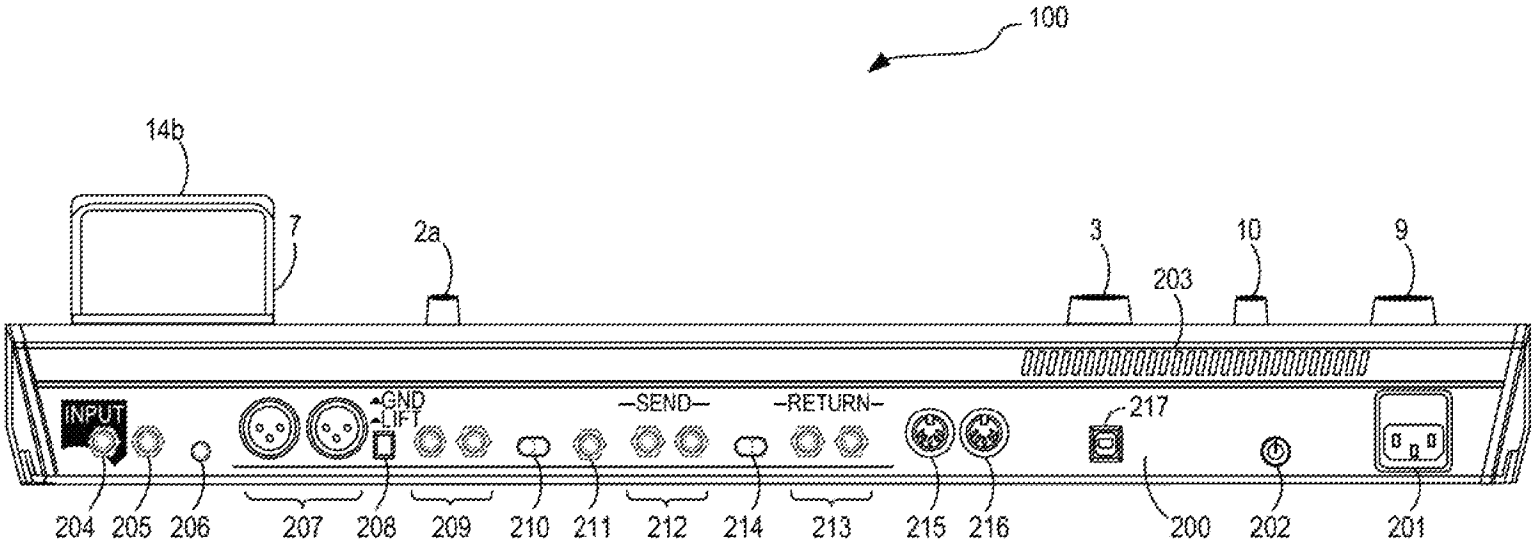
FIG. 2 illustrates a back view of an exemplary multi-effects unit.

Multi-effects unit 100 may have a rear panel 200. FIG. 2 shows one illustrative embodiment of a rear panel 200. Rear panel 200 comprises a power input socket 201 for connecting multi-effects unit 100 to a power outlet using a power cable. Rear panel 200 comprises a power switch 202 to power on and power off multi-effects unit 100. Rear panel 200 comprises a vent 203 for removing heat from within multi-effects unit 100.

Rear panel 200 comprises a guitar input jack 204 to which a guitar may be connected using, for example, a tip-sleeve ¼-inch cable. Rear panel 200 comprises a expression-pedal input jack 205, to which an expression pedal external to multi-effects unit 100 may be connected using, for example, a tip-ring-sleeve ¼-inch cable. Rear panel 200 comprises an auxiliary input jack 206, to which an audio source external to multi-effects unit 100 may be connected using, for example, a ⅛-inch stereo cable.

Rear panel 200 comprises XLR output jacks 207, which may be connected to an external audio system (e.g., active loudspeakers) using, for example, XLR cables. Rear panel 200 comprises a ground-lift switch 208, which may be depressed to disconnect the ground connectors within XLR output jacks 207 from ground pins in XLR cables connected to multi-effects unit 100. Doing so may eliminate humming noise audible in an external audio system connected to multi-effects unit 100. Rear panel 200 comprises ¼-inch output jacks 209 for connecting an external audio system (e.g., an audio interface) to multi-effects unit 100 using, for example, tip-ring-sleeve ¼-inch cables. Rear panel 200 comprises a output level selector 210 for selecting whether the output through ¼-inch output jacks 209 is at a guitar-amplifier level or at a line level. Multi-effects unit 100 comprises a ¼-inch headphones output jack 211 for connecting headphones to multi-effects unit 100.

Rear panel 200 comprises send output jacks 212 and return input jacks 213 for connecting an external audio-effect device to multi-effects unit 100 or for inserting multi-effects unit 100 to the send and return signal path of an external audio device (e.g., a guitar amplifier). Rear panel 200 comprises a rack/stomp selector 214 for selecting the level of the signal outputted from send output jacks 212 (e.g., a line level or a standard guitar-pedal output level).

Rear panel 200 comprises MIDI input jack 215 and MIDI output jack 216 for connecting external MIDI device(s) to multi-effects unit 100. Rear panel 200 comprises USB port 17 for connecting multi-effects unit 100 to a computer over a USB cable. USB port 17 may be used to send and/or receive digital audio signals, as well as import or export presets, amplifier model presets, and impulse response files (e.g., for simulating the sonic characteristics of guitar amplifiers, speakers, or speaker cabinets). USB port 17 may be used to update the firmware on multi-effects unit 100.

As discussed above, an audible gap may be introduced into the audio signal outputted by multi-effects unit 100 when retrieving a preset from memory and providing the data associated with a preset for a processor to process the guitar signal based on the preset. This audible gap may be undesirable to a guitarist seeking to continuously play while changing the effects, signal chain, and/or parameters used by multi-effects unit 100 (e.g., by changing the preset). This may be especially noticeable when switching from a preset that has delay or reverberation (i.e., "reverb") effects activated. These time-based effects extend the duration of an audio signal. Stopping the processing of an audio signal or portion thereof using a preset with these effects before the delayed or reverberated audio signal completes its decay below an audible threshold may be perceived by a listener as an undesirable and sudden cessation of sound and/or distortion.

In an exemplary embodiment, multi-effects unit 100 provides a tail feature by which a first portion of a guitar signal being processed based on parameters specified by a first preset continues to be processed after a second preset is selected for processing a second portion of the guitar signal. For example, a guitarist may select a first preset on multi-effects unit 100 and play a guitar part (e.g., a first portion of the guitar signal), select a second preset on multi-effects unit 100, and continue playing (e.g., generating the second portion of the guitar signal). If the tail feature is enabled, multi-effects unit 100 continues processing the first portion of the guitar signal using parameters specified by the first preset while simultaneously processing the second portion of the guitar signal using parameters specified by the second preset. The processed first portion and the processed second portion of the guitar signal may be simultaneously outputted. For example, if the first preset has a delay effect activated and the guitarist plays a first chord before switching to the second preset and playing a second chord, the delayed echoes of the first chord (e.g., the first portion of the guitar signal) are outputted together with the second chord (e.g., the second portion being processed based on the second preset)—even if the second preset has the delay effect deactivated. It is to be understood that the first portion of the inputted guitar signal does not have to be entire the portion of the inputted guitar signal received between selection of the first present and selection of the second present. The first portion of the inputted guitar signal may be a sub-portion of the inputted guitar signal received between selection of the first present and selection of the second present. Such sub-portion may be considered to be processed with the first preset in response to selection of the first preset (e.g., when the processing is triggered by pressing a footswitch 4*a*, 4*b*).

Figure 3:
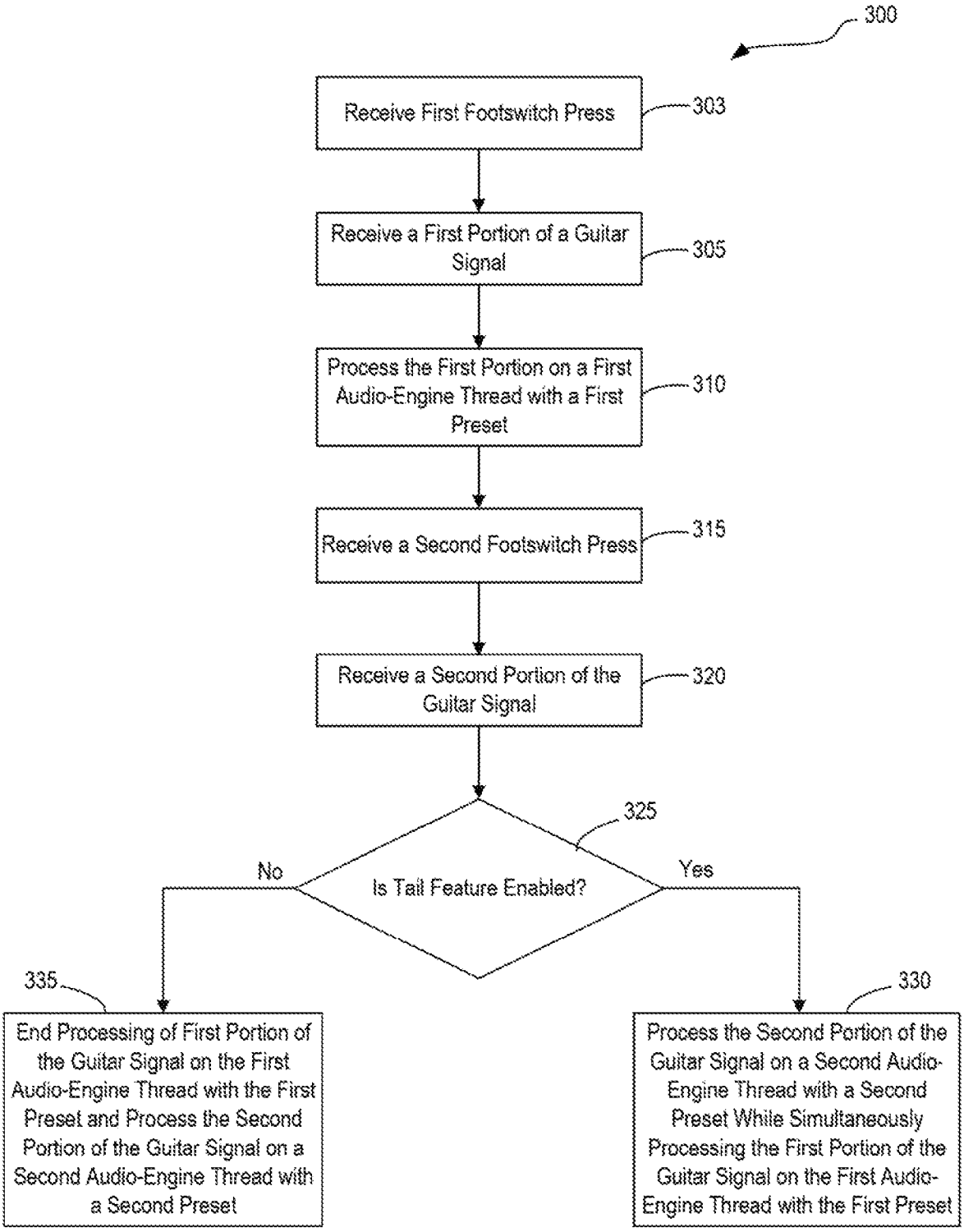
FIG. 3 illustrates an exemplary process for gapless audio preset switching.

In certain embodiments, the foregoing method may comprise an exemplary process 300 for implementing gapless audio preset switching illustrated in FIG. 3. Process 300 comprises multi-effects unit 100 receiving a first footswitch press (step 303). The first footswitch press is a guitarist's selection of a first preset on multi-effects unit 100. The guitarist plays a guitar connected to multi-effects unit 100. Multi-effects unit 100 receives this first portion of a guitar signal (step 305). Multi-effects unit 100 processes the first portion of the guitar signal using parameters specified by the first preset (step 310). Multi-effects unit 100 receives a second footswitch press (step 315). The second footswitch press is the guitarist's selection of a second preset on multi-effects unit 100. In some embodiments, multi-effects unit 100 may gradually decrease the amplitude of the first guitar signal being inputted into a processing component of multi-effects unit 100 in response to the guitarist's selection of the second preset. Doing so may prevent a sudden break in the first portion of the signal—being processed based on the first preset—thereby avoiding undesirable sonic distortion or an abrupt cutoff of the first portion of the signal being processed. The guitarist may continue playing the guitar connected to multi-effects unit 100. Multi-effects unit 100 may receive this second portion of the guitar signal (step 320). In certain embodiments, multi-effects unit 100 may gradually increase the amplitude of the second portion of the guitar signal—being inputted into a processing component of multi-effects unit 100—in response to the guitarist's selection of the second preset. Doing so may prevent a sudden spike in the second portion of the guitar signal—being processed based on the second preset—thereby avoiding undesirable sonic distortion or an undesirably fast attack in the second portion of the guitar signal's attack-decay-sustain-release envelope. In some embodiments, multi-effects unit 100 may gradually increase the amplitude of a signal being outputted from a processing component of multi-effects unit 100 or gradually increasing the amplitude of a signal derived from such outputted signal. Doing so may prevent undesirable sonic distortion or an abrupt spike in the outputted signal based on the second preset. Subsequent functionality of multi-effects unit 100 may be determined by whether the tail feature is enabled (step 325).

If the tail feature is enabled, multi-effects unit 100 may process the second portion of the guitar signal using parameters specified by the second preset on multi-effects unit 100 while simultaneously processing the first portion of the guitar signal using parameters specified by the first preset (step 330). This may be accomplished using, for example, multiprocessing and/or multithreading. In the case of multiprocessing, a first audio-engine thread associated with the first guitar preset and the first portion of the guitar signal may be run on a first core or on a first processor while a second audio-engine thread associated with the second guitar preset and the second portion of the guitar signal may be run on a second core or on a second processor. Instead or in addition to being run on two different cores or processors, the first audio-engine thread and the second audio-engine thread may be run on a single core located on a single processor. Examples of processors include, without limitation, general-purpose processors, digital signal processors, field-programmable gate arrays, and complex programmable logic devices. In some embodiments, the gradual increase of an outputted signal based on the second preset may occur while outputting a signal based on the first preset. In certain embodiments, multi-effects unit 100 comprises a buffer memory that stores some or all of the first portion of the guitar signal. A processing component in multi-effects unit 100 may read the stored first portion of the guitar signal in order to process this portion while simultaneously processing the second portion of the guitar signal. The processing component in multi-effects unit 100 may continue to do this until the entire first portion of the guitar signal available in the buffer memory has been read.

If the tail feature is disabled, the processing component in multi-effects unit 100 may end the output of a first thread for processing the first portion of the guitar signal—or a signal derived therefrom—and process the second portion of the guitar signal on a second thread for processing the second portion of the guitar signal (step 335).

Figure 4A:
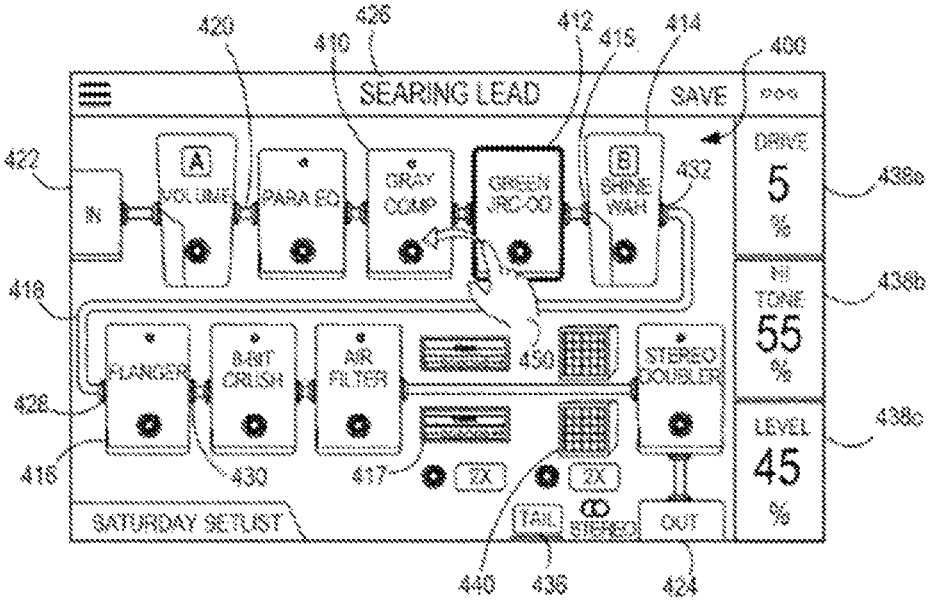
FIGS. 4A and 4B illustrates exemplary displays.
Figure 4B:
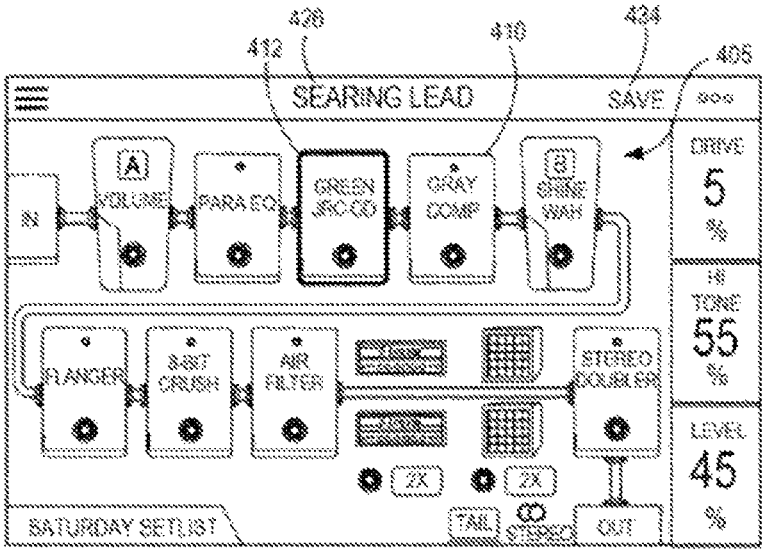

FIGS. 4A and 4B illustrate exemplary displays of signal chains 400 and 405, respectively, on display 1 of multi-effects unit 100. The display of signal chain 400 of FIG. 4A shows multiple discrete guitar-effect pedals (e.g., pedals 410, 412, 414, and 416) and simulated connections (e.g., connections 418 and 420) between connection points (e.g., connection points 432 and 428) on pedals and other components. The discrete guitar-effect pedals or other simulated effect units (e.g., guitar amplifiers or speaker cabinets) with their simulated connections are referred to as a signal chain (e.g., signal chain 400). The image of pedal 410 in signal chain 400 indicates that a guitar effect titled "Gray Comp" may be activated or deactivated by pressing a footswitch 4*a*, 4*b* on multi-effects unit 100. Similarly, an image of pedal 412 in signal chain 400 indicates that a guitar effect titled "Green JRC-OD" may be activated or deactivated by pressing a footswitch 4*a*, 4*b* on multi-effects unit 100. In some embodiments, a footswitch 4*a*, 4*b* on multi-effects unit 100 may be used to activate or deactivate more than one guitar effect pedal. The display of signal chain 400 shows images of guitar amplifier 417 and speaker cabinet 440 to which the signal is routed. The presence of guitar amplifier 417 indicates that the guitar signal is fed to an amplifier-modeling effect, which may be activated by pressing a footswitch 4*a*, 4*b* on multi-effects unit. The presence of speaker cabinet 440 indicates that the guitar signal is fed to a cabinet-modeling effect, which may be activated by pressing a footswitch 4*a*, 4*b* on multi-effects unit 100. Signal chain 400 has in input block 422 and an output block 424. Inputted guitar signals, or signals derived therefrom, travel from input block 422, through a plurality of effect units (e.g., pedals), and into output block 424 via a plurality of simulated connections. Pedals and input block 422 and output block 424 may have an input connection point, such as input connection point 428, and output connection, such as output connection point 430, on pedal 416. Signal is routed, for example, from pedal 414 to pedal 416 by creating a simulated connection 418 between output connection point on 432 on pedal 414 and input connection point 428 on pedal 416. Simulated connection 418 (e.g., a cable) is displayed between output connection point on 432 on pedal 414 and input connection point 428 on pedal 416 to indicate that incoming guitar signal is routed from pedal 414 to pedal 416. Pedals, guitar amplifiers, and speaker cabinets are displayed in different colors and shapes in order to assist a user in quickly discerning which pedals, amplifiers, and cabinets are in a preset's signal chain and what order and arrangement the pedals, amplifiers, and cabinets are connected in. A user may select a pedal to change its color. The titles of the effects, amplifiers, and cabinets displayed thereon may also assist a user in quickly discerning which pedals, amplifiers, and cabinets are in a preset's signal chain and what order and arrangement the pedals, amplifiers, and cabinets are connected in. Effect pedal 414 may be associated with an effect that has a parameter value adjusted by expression pedal 7. For example, if effect pedal 414 is associated with a wah-wah effect, expression pedal 7 may control the peak frequency of this effect. For example, pressing on bottom portion 14*a* of expression pedal 7 with a user's heal may lower the peak frequency whereas pressing on top portion 14 b of expression pedal 7 with a user's toe may raise the peak frequency.

A user may wish to change the order in which pedals in signal chain 400 receive inputted guitar signals. For example, a user may want pedal 412 (Green JRC-OD) to receive inputted guitar signals before pedal 410 (Gray Comp). A user may do so by touching the image of pedal 412 on display 1 and dragging the image of pedal 412 to the position on the signal chain the user wants pedal 412 to occupy (i.e., the position of pedal 410). This position is referred to as the destination position. The user may release their contact with display 1 once the image of pedal 412 has been dragged to the destination position to select the new signal chain arrangement. The resulting signal chain 405, illustrated in FIG. 4B, shows pedal 412 appearing before pedal 410 in signal chain 405. This physical action is illustrated with hand-and-arrow 450 (not actually displayed on display 1).

A user may wish to move the connection point of a connection from one pedal to another. For example, a user may want pedal 412 to feed signal directly into pedal 416 without first going through pedal 414. To do this, a user may select connection point 415 and drag it to connection point 428, thereby creating a simulated connection between pedals 412 and 428 while skipping pedal 414 in the signal chain. Instead or in addition, a user may delete pedal 414 by tapping on it and selecting a delete button (not shown). In some embodiments, a user may drag connection 418 between another pair of pedals to establish a connection between them and delete the connection between pedals 414 and 428.

A signal chain may be specified by a saved preset, which may be recalled at a later time by a user. Preset title 426 is displayed above signal chain 400. A user may display a list of available presets by pressing down substantially near or on the portion of display 1 showing bar 445 and dragging their finger downward on display 1 (i.e., swiping down). When a user selects another preset, display 1 may display another signal chain that is associated with the selected preset and display a different title 426. In the foregoing example of changing the order in which pedals 410 and 412 in signal chain 400 receive the inputted guitar signal, a user may select the save button 434 to save the changes he or she made to the preset with the title displayed at 426.

A user may activate or deactivate the tail feature discussed above with respect to FIG. 3 by selecting tail button 436.

As discussed above, parameters 438*a*, 438*b*, and 438*c* may be displayed next to signal chain 400 and be adjusted with knobs 2*a*, 2*b*, and 2*c*.

Figure 5:
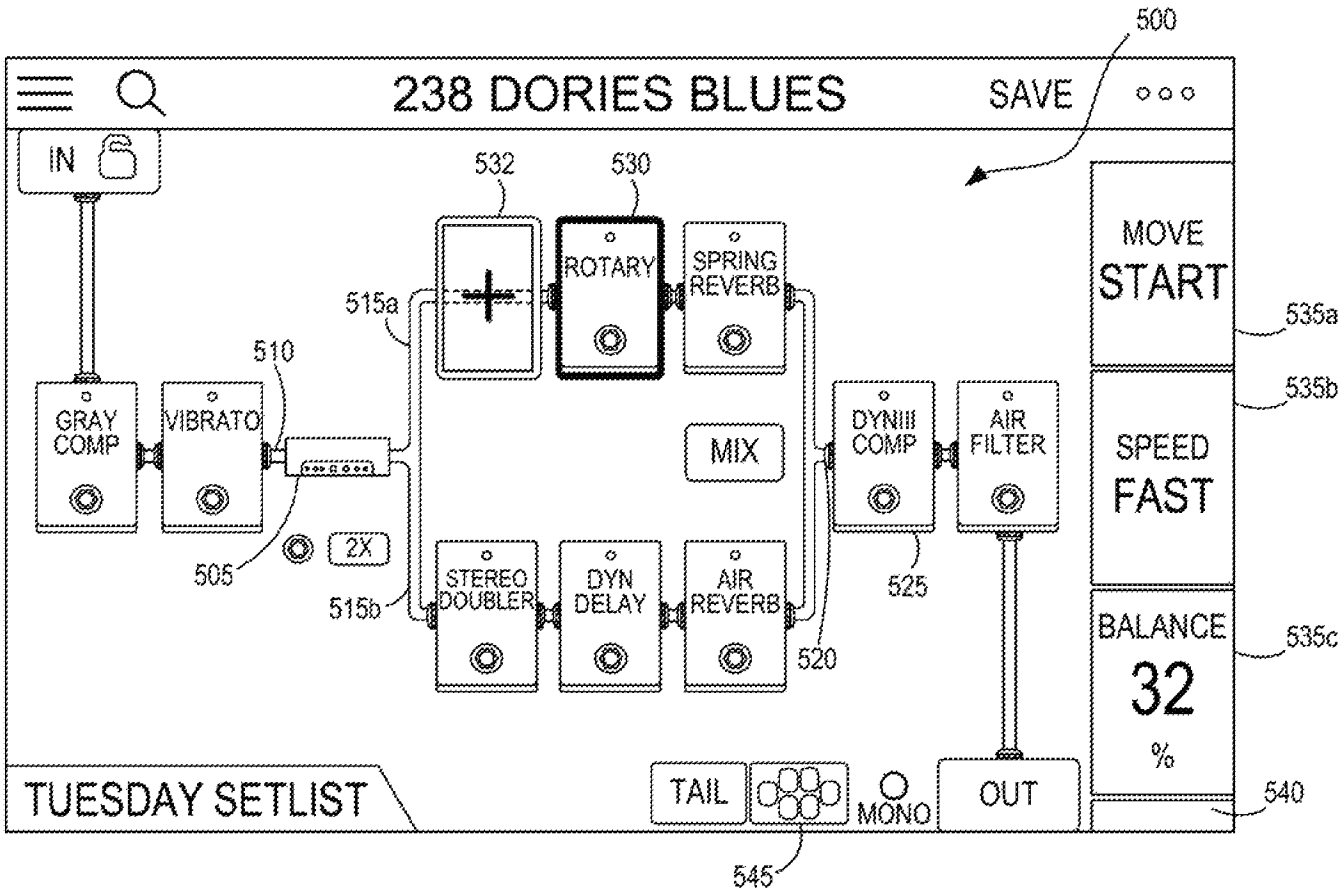
FIG. 5 illustrates another exemplary display.

While signal chain 400 in FIG. 4A has pedals connected in series, a signal chain may have two or more pedals connected in parallel. FIG. 5 illustrates an exemplary signal chain 500. In signal chain 500, an effect unit 505 may receive a single guitar signal input over connection 510 and output two signals that travel in parallel over connections 515*a* and 515*b*, respectively. The two signals may be combined (e.g., mixed) into a single signal at connection point 520 and the mixed signal fed to effect pedal 525. A user may select button 545 to select whether the signal will begin and end as a series connection of pedals; begin as a series connection, split into a parallel connection, and end as a single connection; or begin with a split of two signals that are later joined into a single connection. The illustration on button 545 may be used to visually indicate which of these modes is selected.

If there is an empty slot in signal chain 500 into which an effect unit may be placed, an empty position 532 with a plus sign, no sign, and/or another sign may be displayed.

To adjust parameters of pedal 530, a user may select pedal 530 by, for example, tapping on the portion of display 1 showing pedal 530. When selected, pedal 530 may have a highlight displayed around it. Parameters pertaining to pedal 530, such as a first set of parameters 535*a,* 535*b,* and 535*c,* are displayed when pedal 530 is selected. The displayed parameters may be adjusted by knobs 2*a,* 2*b,* and 2*c,* as discussed with respect to FIG. 1. If there are more parameters than the number of knobs with which to adjust them, display 1 may show the top portion 540 of another set of parameters. The other set of parameters can be selected for display and adjustment by knobs 2*a,* 2*b,* and 2*c* by tapping on the portion display 1 showing the first set of parameters 535*a,* 535*b,* and 535*c.* In some embodiments, a user may assign which parameter a knob will control.

Figure 6:
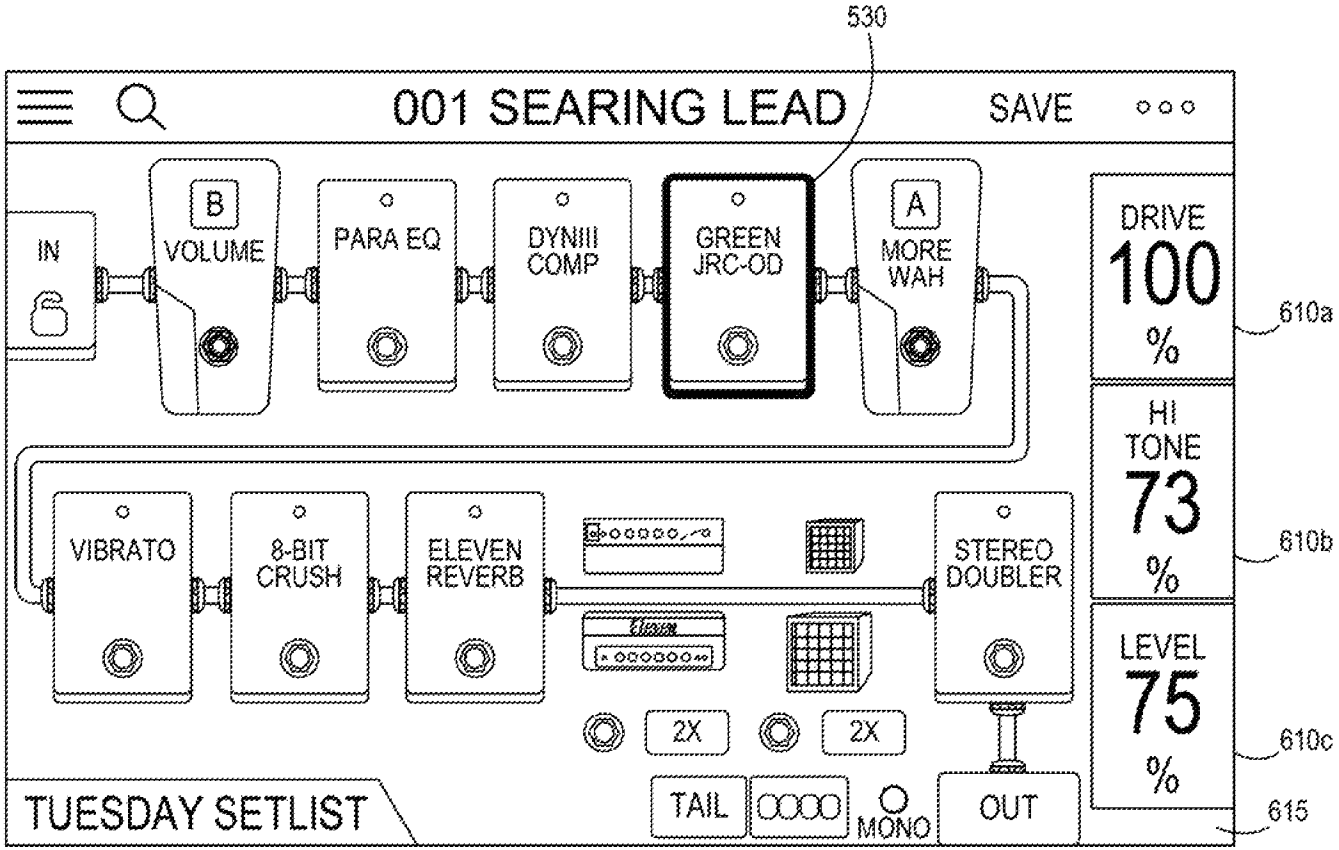
FIG. 6 illustrates another exemplary display.

Not all effect pedals have more adjustable parameters than there are knobs with which to make the adjustments. For example, effect pedal 530 of FIG. 6 has only three parameters that may be adjusted: 610*a,* 610*b,* and 610*c.* In this case, the area 615 below 610*c* does not have a portion of another parameter set displayed, indicating that there are no other parameters that may be adjusted with knobs 2*a,* 2*b,* and 2*c* on pedal 530.

Certain embodiments of the present disclosure may be implemented as software on a general-purpose computer or on another device.

The foregoing description has been presented for purposes of illustration. It is not exhaustive and is not limited to the precise forms or embodiments disclosed. Modifications and adaptations will be apparent to those skilled in the art from consideration of the specification and practice of the disclosed embodiments.

The features and advantages of the disclosure are apparent from the detailed specification, and thus, it is intended that the appended claims cover all systems and methods falling within the true spirit and scope of the disclosure. As used herein, the indefinite articles "a" and "an" mean "one or more." Similarly, the use of a plural term does not necessarily denote a plurality unless it is unambiguous in the given context. Words such as "and" or "or" mean "and/or" unless specifically directed otherwise. Further, since numerous modifications and variations will readily occur from studying the present disclosure, it is not desired to limit the disclosure to the exact construction and operation illustrated and described, and, accordingly, all suitable modifications and equivalents falling within the scope of the disclosure may be resorted to.

Computer programs, program modules, and code based on the written description of this specification, such as those used by the microcontrollers, are readily within the purview of a software developer. The computer programs, program modules, or code can be created using a variety of programming techniques. For example, they can be designed in or by means of Java, C, C++, assembly language, or any such programming languages. One or more of such programs, modules, or code can be integrated into a device system or existing communications software. The programs, modules, or code can also be implemented or replicated as firmware or circuit logic.

Another aspect of the disclosure is directed to a non-transitory computer-readable medium storing instructions which, when executed, cause one or more processors to perform the methods of the disclosure. The computer-readable medium may include volatile or non-volatile, magnetic, semiconductor, tape, optical, removable, non-removable, or other types of computer-readable medium or computer-readable storage devices. For example, the computer-readable medium may be the storage unit or the memory module having the computer instructions stored thereon, as disclosed. In some embodiments, the computer-readable medium may be a disc or a flash drive having the computer instructions stored thereon.

Moreover, while illustrative embodiments have been described herein, the scope of any and all embodiments include equivalent elements, modifications, omissions, combinations (e.g., of aspects across various embodiments), adaptations and/or alterations as would be appreciated by those skilled in the art based on the present disclosure. The limitations in the claims are to be interpreted broadly based on the language employed in the claims and not limited to examples described in the present specification or during the prosecution of the application. The examples are to be construed as non-exclusive. Furthermore, the steps of the disclosed methods may be modified in any manner, including by reordering steps and/or inserting or deleting steps. It is intended, therefore, that the specification and examples be considered as illustrative only, with a true scope and spirit being indicated by the following claims and their full scope of equivalents.

What is claimed is:

1. A multi-effects apparatus, comprising:

a tail control having two operational states, a first operational state of which is associated with gradual amplitude changes;

one or more switches;

a memory storing one or more effect presets for processing an inputted audio signal when triggered by a change in status of at least one of the switches; and one or more processors coupled to the memory, the one or more processors configured to:

process a first portion of an inputted audio signal on a first audio-engine thread with a first effect preset when processing the first portion is triggered by at least one of the one or more switches, and process a second portion of the inputted audio signal on a second audio-engine thread with a second effect preset while simultaneously processing the first portion of the inputted audio signal on the first audio-engine thread with the first effect preset when processing the second portion is triggered by at least one of the switches, wherein the one or more processors are further configured to gradually increase or decrease an amplitude of one of the first or second portions of the inputted audio signal in response to the triggering of at least one of the switches and the tail control being in the first operational state.

2. The multi-effects apparatus of claim 1, wherein the one or more processors are further configured to simultaneously output the first portion of the inputted audio signal processed on the first audio-engine thread and the second portion of the inputted audio signal on the second audio-engine thread.

3. The multi-effects apparatus of claim 1, wherein the one or more processors are further configured to gradually decrease an amplitude of the inputted audio signal processed with the first audio-engine thread in response to a change in status of at least one of the switches.

4. The multi-effects apparatus of claim 1, wherein the one or more processors are further configured to gradually increase an amplitude of the inputted audio signal processed with the second audio-engine thread in response to a change in status of at least one of the switches.

5. The multi-effects apparatus of claim 1, wherein the one or more processors are further configured to gradually increase an amplitude of an output signal from the second audio-engine thread in response to a change in status of at least one of the switches.

6. The multi-effects apparatus of claim 1, wherein the one or more processors are further configured to produce an output signal from the first audio-engine thread while simultaneously gradually increasing an amplitude of an output signal from the second audio- engine thread in response to a change in status of at least one of the switches.

7. A system comprising a processor and a non-transitory computer-readable storage medium storing instruction that, when executed by the processor, cause the processor to perform a method, the method comprising:

processing a first portion of an inputted audio signal on a first audio-engine thread with a first effect preset when processing of the first portion is triggered by a change in status of at least one of a plurality of switches, and processing a second portion of the inputted audio signal on a second audio-engine thread with a second effect preset while simultaneously processing the first portion of the inputted audio signal on the first audio-engine thread when processing of the second portion is triggered by a change in status of at least one of the plurality of switches, and gradually increasing or decreasing an amplitude of one of the first or second portions of the inputted audio signal in response to the triggering of at least one of the switches while a tail control having two operational states, is in a first operational state associated with gradual amplitude changes, else, discontinuing processing of one of the first or second portions of the inputted audio signal.

8. The system of claim 7, wherein the method further comprises simultaneously outputting the first portion of the inputted audio signal processed on the first audio-engine thread and the second portion of the inputted audio signal on the second audio-engine thread.

9. The system of claim 7, wherein the method further comprises gradually decreasing an amplitude of the inputted audio signal processed on the first audio-engine thread in response to a change in status of at least one of the switches.

10. The system of claim 7, wherein the method further comprises gradually increasing an amplitude of the inputted audio signal processed on the second audio-engine thread in response to a change in status of at least one of the switches.

11. The system of claim 7, wherein the method further comprises gradually increasing an amplitude of an output signal from the second audio-engine thread in response to a change in status of at least one of the switches.

12. The system of claim 7, wherein the method further comprises producing an output signal from the first audio-engine thread while simultaneously gradually increasing an amplitude of an output signal from the second audio-engine thread in response to a change in status of at least one of the switches.

13. The system of claim 7, wherein the method further comprises gradually decreasing an amplitude of an output signal from the first audio-engine thread while simultaneously gradually increasing an amplitude of an output signal from the second audio-engine thread in response to a change in status of at least one of the switches.

14. A non-transitory computer-readable medium storing instructions executable by at least one processor to facilitate gapless audio preset switching according to a method, the method comprising:

processing a first portion of an inputted audio signal on a first audio-engine thread with a first effect preset when processing of the first portion is triggered by a change in status of at least one of the plurality of switches, processing a second portion of the inputted audio signal on a second audio-engine thread with a second effect preset while simultaneously processing the first portion of the inputted audio signal on the first audio-engine thread when processing of the second portion is triggered by a change in status of at least one of the plurality of switches, and gradually increasing or decreasing an amplitude of one of the first or second portions of the inputted audio signal in response to the triggering of at least one of the switches while a tail control having two operational states, is in a first operational state associated with gradual amplitude changes, else, discontinuing processing of one of the first or second portions of the inputted audio signal.

15. The non-transitory computer-readable medium of claim 14, wherein the method further comprises simultaneously outputting the first portion of the inputted audio signal processed on the first audio-engine thread and the second portion of the inputted audio signal on the second audio-engine thread.

16. The non-transitory computer-readable medium of claim 14, wherein the method further comprises gradually decreasing an amplitude of the inputted audio signal processed on the first audio-engine thread in response to a change in status of at least one of the switches.

17. The non-transitory computer-readable medium of claim 14, wherein the method further comprises gradually increasing an amplitude of the inputted audio signal processed on the second audio-engine thread in response to a change in status of at least one of the switches.

18. The non-transitory computer-readable medium of claim 14, wherein the method further comprises gradually increasing an amplitude of an output signal from the second audio-engine thread in response to a change in status of at least one of the switches.

19. The non-transitory computer-readable medium of claim 14, wherein the method further comprises producing an output signal from the first audio-engine thread while simultaneously gradually increasing an amplitude of an output signal from the second audio- engine thread in response to a change in status of at least one of the switches.

20. The non-transitory computer-readable medium of claim 14, wherein the method further comprises gradually decreasing an amplitude of an output signal from the first audio-engine thread while simultaneously gradually increasing an amplitude of an output signal from the second audio-engine thread in response to a change in status of at least one of the switches.

* * * * *